US010782080B1

(12) United States Patent
Mitchell

(10) Patent No.: US 10,782,080 B1
(45) Date of Patent: Sep. 22, 2020

(54) MODULAR BLOCK WEAPON

(71) Applicant: Jeffrey R. Mitchell, Tallahassee, FL (US)

(72) Inventor: Jeffrey R. Mitchell, Tallahassee, FL (US)

(73) Assignee: SMAN Management, LLC, Tallahassee, FL (US)

( * ) Notice: Subject to any disclaimer, the term of this patent is extended or adjusted under 35 U.S.C. 154(b) by 0 days.

(21) Appl. No.: 16/519,409

(22) Filed: Jul. 23, 2019

(51) Int. Cl.

| | |
|---|---|
| ***F41A 3/66*** | (2006.01) |
| ***F41C 23/20*** | (2006.01) |
| ***F41A 21/48*** | (2006.01) |
| ***F41A 11/02*** | (2006.01) |

(52) U.S. Cl.
CPC ..... *F41A 3/66* (2013.01); *F41A 11/02* (2013.01); *F41A 21/48* (2013.01); *F41C 23/20* (2013.01)

(58) Field of Classification Search
CPC .. F41A 3/66; F41A 11/02; F41A 21/48; F41C 23/20; F41C 23/06
USPC ..... 42/75.01, 75.02, 75.03, 72, 90, 1.06, 42/71.01
See application file for complete search history.

(56) References Cited

U.S. PATENT DOCUMENTS

| | | | | |
|---|---|---|---|---|
| 2,702,958 A * | 3/1955 | Boroszewski | F41A 21/485 | 42/75.01 |
| 2,717,465 A * | 9/1955 | Clark, Jr. | F41C 23/00 | 42/75.01 |
| 3,207,036 A * | 9/1965 | Norton | F41A 5/18 | 89/191.01 |
| 4,430,822 A * | 2/1984 | Fromming | F41A 3/66 | 42/71.01 |
| 4,473,964 A * | 10/1984 | Straub | F41A 25/22 | 124/68 |
| 5,123,194 A * | 6/1992 | Mason | F41A 3/86 | 42/75.02 |
| 5,794,374 A * | 8/1998 | Crandall | F41C 27/22 | 42/76.01 |
| 5,834,678 A * | 11/1998 | Kalb | F41A 3/46 | 89/187.01 |
| 6,571,676 B1 * | 6/2003 | Folsom | F41A 3/74 | 42/75.02 |
| 8,220,194 B2 * | 7/2012 | Crow | F41A 21/482 | 42/75.02 |

* cited by examiner

*Primary Examiner* — John Cooper
(74) *Attorney, Agent, or Firm* — J. Wiley Horton

(57) ABSTRACT

A modular weapon in which the recoil transferring feature attaches to the barrel proximate the breech end of the barrel. The inventive approach allows the assembly of the barrel and the receiver to flex freely while still providing a path for the recoil impulse to travel to an external object—such as the body of the shooter in the case of a shoulder-fired rifle embodiment. This novel approach increases accuracy.

20 Claims, 22 Drawing Sheets

MODULAR BLOCK WEAPON

BACKGROUND OF THE INVENTION

1. Field of the Invention

This invention relates to the field of firearms. More specifically, the invention comprises a modular weapon design that improves accuracy by limiting external interference on the natural harmonics of the barrel/action assembly.

2. Description of the Related Art

The present invention is particularly well-suited to hand-held rifles, though it may find application to other projectile launching devices as well. Rifles originally consisted of a long steel or iron barrel mated to a wooden stock. In the muzzleloader era, a separate lock mechanism was used to ignite the powder charge contained within the sealed breech-end of the barrel. Such rifles were typically made by hand. The wooden stock was carefully inletted to fit tightly around the band and the look mechanism. Iron bands were then shrunk over the assembly of the barrel and the stock.

For repeatable accuracy, the barrel must be held reasonably stationary while the projectile accelerates through the bore (sometimes known as "internal ballistics"). There must also be some facility to grip and properly aim the barrel. The stock serves these purposes. In effect, the stock is a human interface for the barrel and firing mechanism. It must provide suitable gripping surfaces. It must also provide a path for the recoil to travel from the barrel to the user. This is customarily through the butt portion of a stock—which the user pulls into his or her shoulder. The transfer of recoil is an important factor, since the barrel will begin to move rearward (and typically upward) during the time that the projectile is still accelerating down the bore.

Early experience suggested that accuracy was maximized by achieving a continuous contact between the barrel and the stock over the entire length of the barrel. It was customary to leave a short length of barrel near the muzzle free of the stock, but this was the result of leaving space for the exposed end of a ramrod rather than any accuracy considerations.

The belief that extensive contact was desirable between the barrel/action and the stock persisted long into the breech-loading era. A goof example is provided by the Mauser model of 1898 (commonly known as the Mauser 98), U.S. Pat. No. 547,933 provides good illustrations and explanations for this type of rifle. In the Mauser 98 design, a cycling bolt is retained within a steel receiver. A male-threaded shank is provided on the breech end of the barrel. A female threaded portion is provided in the forward end of the receiver (commonly known as the "ring"). The barrel is threaded into the end of the reciever. Significant torque is applied to this threaded joint so that the barrel and receiver effectively become locked together.

FIG. 1 is a sectional elevation view showing a simplified depiction of a Mauser 98-type bolt action receiver and barrel in an assembled state (some internal features have been omitted to simplify the depiction). In this view, barrel 12 is threaded into receiver 14. FIG. 2 shows the same components in a disassembled state. The reader will note that threaded shank 21 includes a male thread sized to thread into female thread 23 in the forward portion of the receiver (receiver ring 15). Barrel shoulder 17 is a planar surface that is perpendicular to the bore of the barrel. Likewise, action face 19 on the forward portion of receiver ring 15 is a planar surface that is perpendicular to the bore of the barrel. When threaded shank 21 is threaded into the receiver ring, barrel shoulder 17 is compressed tightly ahainst action face 19. This action is often referred to as "crush," thoough the compressive deformation of the two surfaces against each other is usually an elastic deformation and not a plastic one. Those skilled in the art will know that an actual Mauser 98 receiver includes a second pair of mating planar surfaces that is aft of the interface between action face 19 and barrel shoulder 17. This second pair of mating surfaces has not been shown for purposes of visual clarity.

The desired degree of compression betwven the mating surfaces 17, 19 is created by applying torque between the barrel and the action. A specified amount of torque is typically applied to produce the desired result. Once this torque has been applied, the barrel and receiver are effectively locked together.

FIG. 3 provides a sectional elevation view through the same area after a wooden stock 25 has been added. The stock includes a cavity shaped to receive the receiver and barrel. The cavity is cut into the upper portion of the stock so that the barrel and receiver can drop down into the cavity. Once in place, action screws are conventionally used to pull the stock tightly against the barrel and receiver.

It has long been known that accuracy is affected by how well the cavity in the stock conforms to the surfaces of the barrel and receiver. This is particularly true in the area of recoil lug 27. The recoil impulse generated by firing a rifle cartridge follows a primary path from the barrel/receiver, to the recoil lug, to the stock, and then to the shooter. The stock-to-receiver-fit in the vicinity of recoil lug 27 is known to be important. The stock-to-receiver fit along the entire length of the receiver considered important. Much of this potential contact area is lost to the presence of a vertically-feeding cartridge magazine. This fact makes the aft portion of the receiver (commonly referred to as the "tang") important in prior art designs. The stock fit in this area is considered important as well.

Carefully fitting the cavity of a wooden stock is a labor-intensive process. It has long been known to fill any gap remaining with a bedding compound. A bedding compound seeks to fill any gaps between the stock and the barrel/receiver. Epoxy resin has been used effectively for this purpose for many years. Many sophisticated formulations now exist. Some include small glass beads as a filler.

As late as WWII, it was still common for a wooden stock to span nearly the entire length of the barrel and receiver. During WWII, however, some armorers discovered that limiting the contact between the barrel/action and receiver to certain specific areas actually improved accuracy. FIG. 3 illustrates this development. The stock fit is close in the vicinity of recoil lug 27 and for a short distance forward of barrel shoulder 17. Proceeding further forward, however, a gap 29 is deliberately left between the barrel and the stock. The inclusion of this gap is sometimes referred to as "free floating" a barrel.

Free floating allows the barrel to flex in its first bending mode (a banana shape) without being damped by contacting the stock. This feature improves accuracy by limiting external influences on the natural resonance of the barrel/action assembly. Minimizing the contact length between the barrel/receiver and stock has the potential of further increasing accuracy. Designers using traditional wooden stocks have been limited by the properties of the material itself. In recent years, more advanced materials have offered the potential to reduce these limitations. However, this potential has largely gone unrealized because the interface between the barrel/receiver and the stock has been driven by tradition. The present invention departs from this tradition and presents a radical new approach.

BRIEF DESCRIPTION OF THE INVENTION

The present invention comprises a modular weapon in which the recoil transferring feature attaches to the barrel proximate the breech end of the barrel. The inventive approach allows the assembly of the barrel and the receiver to flex freely while still providing a path for the recoil impulse to travel to an external object—such as the body of the shooter in the case of a shoulder-fired ridle embodiment. This approach increases accuracy.

REFERENCE NUMERALS IN THE DRAWINGS

Figure 1:
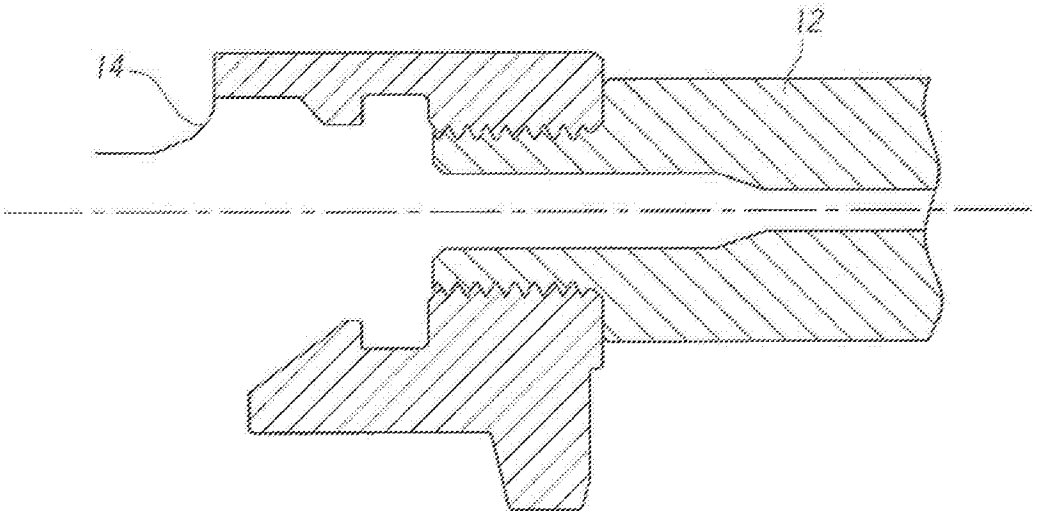
FIG. 1 (PRIOR ART)
FIG. 1 is a sectional elevation view, showing a prior art configuration for a barrel joined to a receiver.
Figure 2:
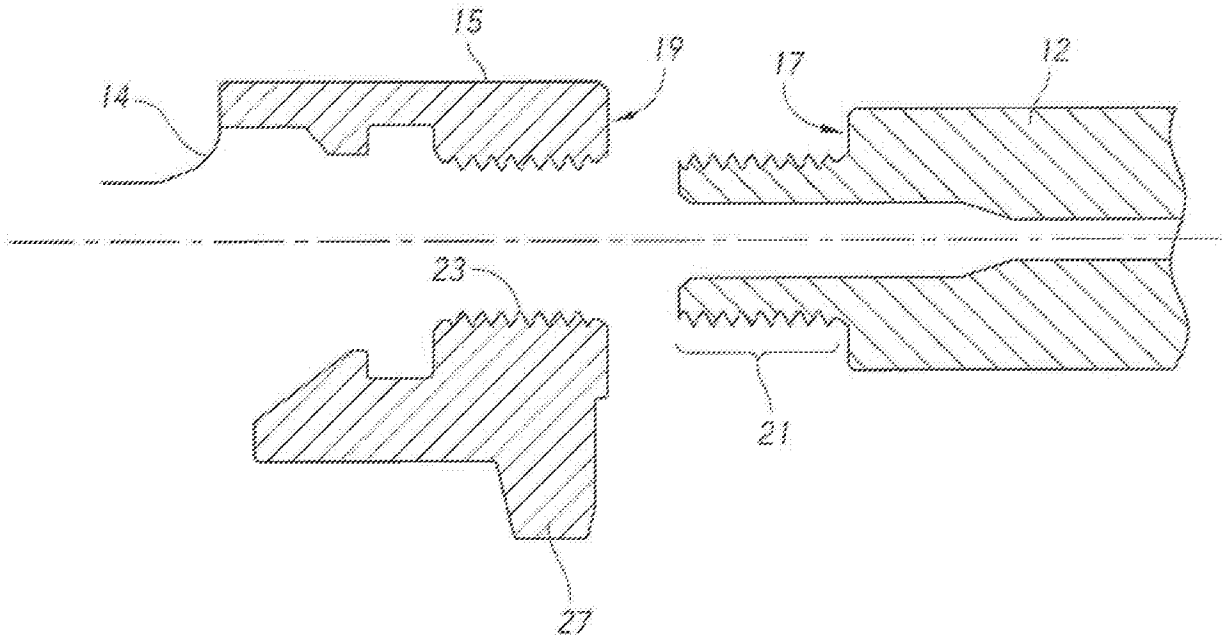
FIG. 2 (PRIOR ART)
FIG. 2 is an exploded sectional elevation view, showing a prior art configuration for a barrel joined to a receiver.
Figure 3:
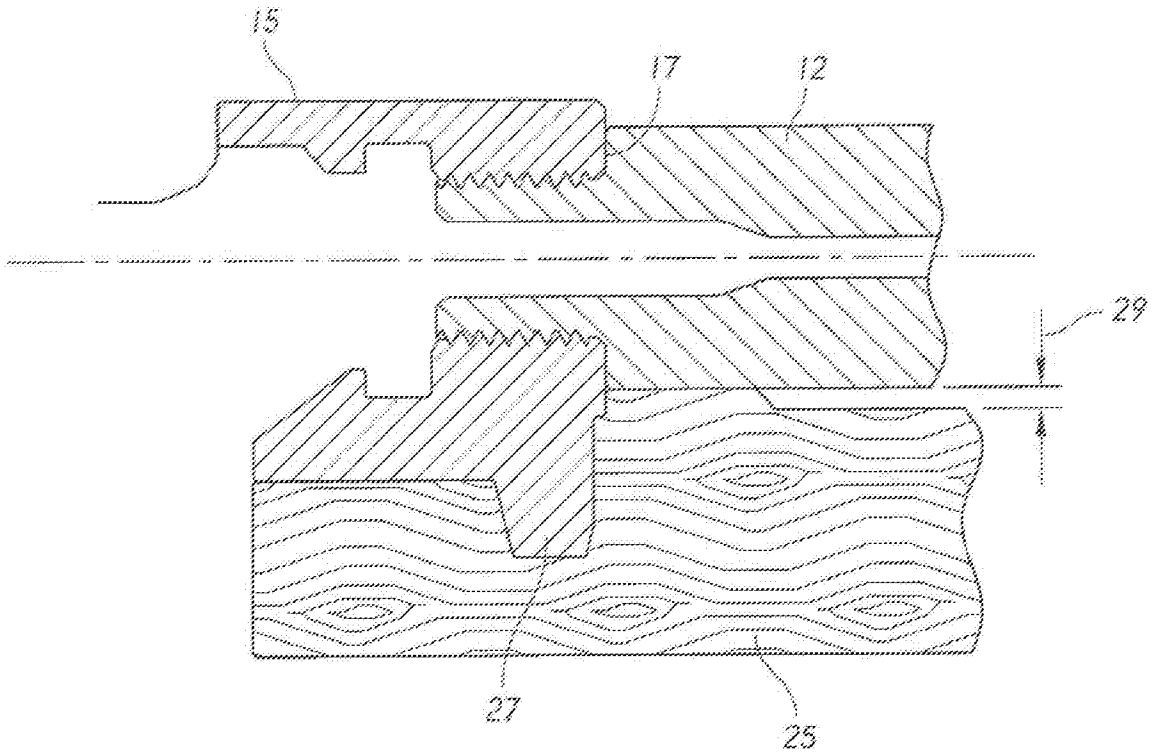
FIG. 3 (PRIOR ART)
FIG. 3 is a sectional elevation view, showing the configuration of FIG. 1 joined to a stock.

10 rifle
12 barrel
14 receiver
15 receiver ring
16 bolt assembly
17 barrel shoulder
18 trigger guard shroud
19 action face
20 pistol grip
21 threaded shank
22 right comb rod
23 female thread
24 left comb rod
26 heel rod
27 recoil lug
28 butt plate
29 gap
30 pad
32 length-of-pull adjustment
34 rear barrel frame
36 central barrel frame
38 forward barrel frame
40 upper right barrel frame
42 upper left barrel rod
44 lower right barrel rod
46 lower left barrel rod
48 upper right barrel rod bore
50 upper left barrel rod bore
52 lower right barrel rod bore
54 lower left barrel rod bore
56 right comb rod bore
58 left comb rod bore
60 injection port
62 scope relief
64 ejection port
66 bolt handle
68 trigger
70 right comb rod bore
71 bottom port
72 left comb rod bore
74 trigger group slot
76 trigger guard
78 trigger group mount
82 feed ramp
84 trigger group
86 rear frame area
88 central frame area
90 barrel groove
92 milled pocket
93 O-ring groove
94 bore
95 frame groove
96 chamber
97 pocket
98 bore
100 fill port
102 bonding material
103 bonding material ring
104 sprue
105 O-ring
106 dome
108 outer portion
110 inner portion
112 telescopic sight
114 scope mount
116 clearance bore

DETAILED DESCRIPTION OF THE INVENTION

Figure 4:
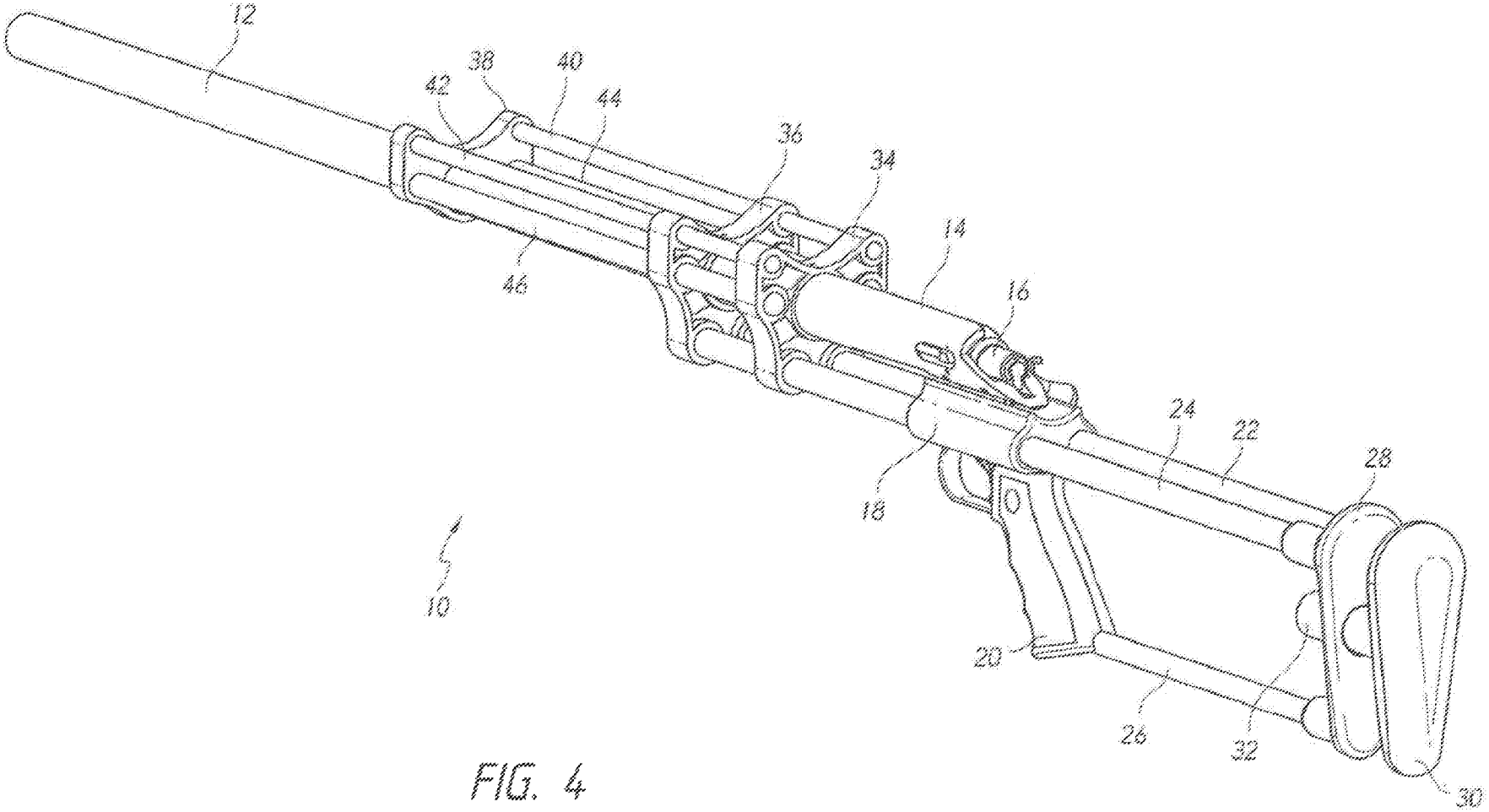
FIG. 4 is a perspective view, showing an embodiment of the present invention in an assembled state.
Figure 5:
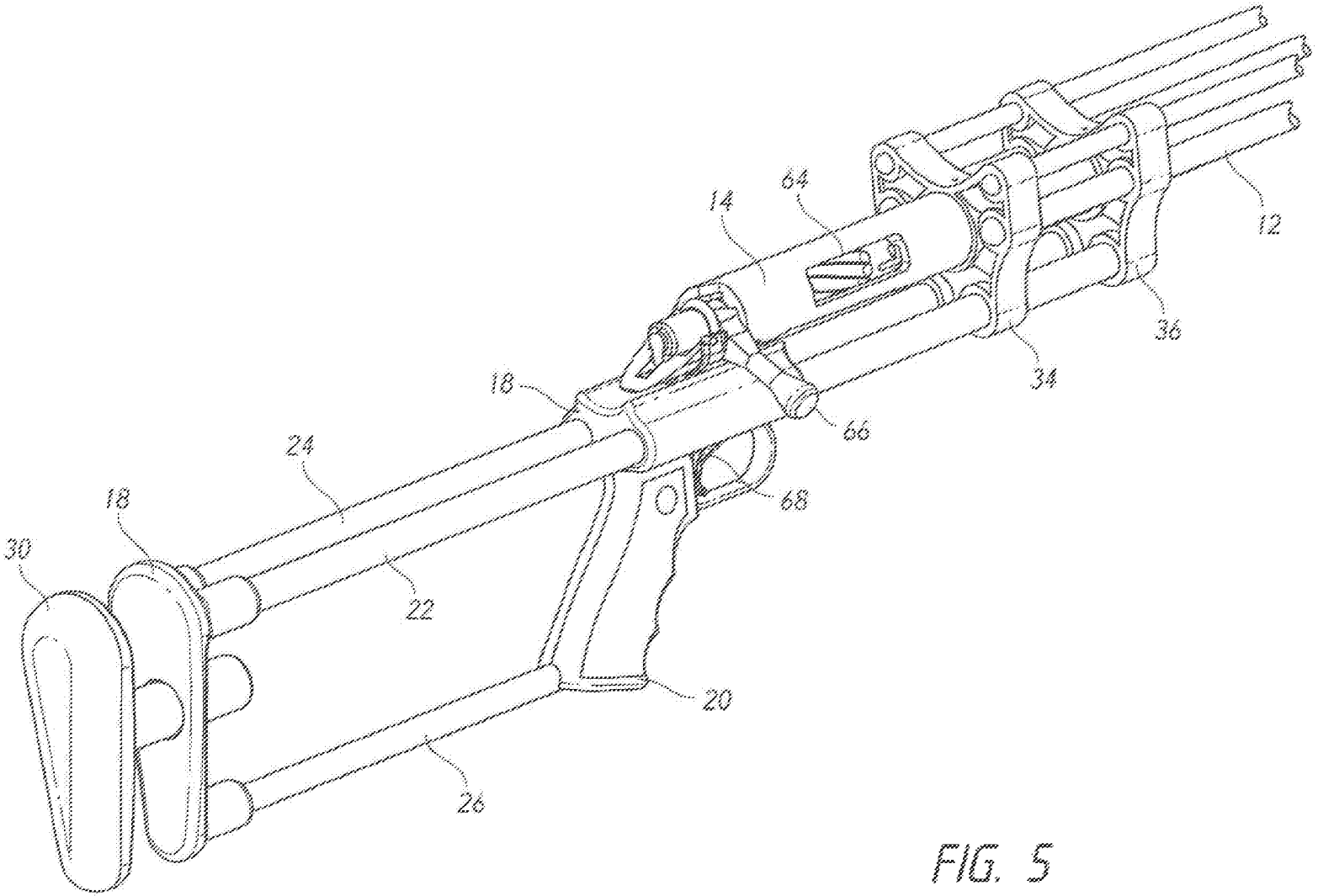
FIG. 5 is a perspective view, showing the receiver arear in more detail.

FIG. 4 provides a perspective view of a preferred embodiment of the invention. In this version a conventional barrel and receiver are used, so the description will begin with these elements and then move to the unconventional elements. Receiver 14 houses bolt assembly 16. Barrel 12 includes a threaded shank that threads into a female thread in the forward portion of receiver 14. This assembly is a conventional design descended from the Mauser 98 as described in the "prior art" section. FIG. 5 shows the right side of the same rifle. The reader will note how bolt handle 66 protrudes from the right side of receiver 14. The bolt handle is shown in the locked position.

Barrel 12 is preferably a thick-walled unit designed for enhanced accuracy. In the embodiment shown, the barrel has a constant outer diameter for its entire length. In the field this is sometimes known as a "bull barrel."

Air is conventional for right-handed bolt-action rifles, bolt handle 66 is rotated counterclockwise to unlock the bolt lugs and then pulled to the rear to extract and eject a spent cartridge casing. The bolt is pushed forward and rotated clockwise in order to push a new round into the chamber and lock the bolt in place. Trigger 68 extends domward from a trigger group that is connected to the rear portion of receiver 14. The trigger and trigger group are conventional prior art components.

Still looking at FIG. 5—rear barrel frame 34 is connected to barrel 12 proximate the breech end of the barrel (proximate the point where the barrel 12 meets the receiver 14). Central barrel frame 36 is connected to barrel 12 some distance forward of rear barrel frame 34. The separation between the rear and central barrel frames is significant to the resonant characteristics of the overall structure and significant to the stiffness of the overall structure. In the example shown, the gap between the rear and central barrel frames is about 10 centimeters. A larger or smaller gap can be used in other embodiments.

The connection between the barrel frames and the barrel is preferably made using a high-strength thermoset elastomer or a high-strength cross-linking polymer (such as a two-part epoxy). This process will be explained in more detail later in this application. In the invention the use of an elastic material as the only point of contact between the barreled action and the stock is preferably. The elastic interface does not unduly damp the high frequency vibrations and pressure waves occurring during the firing process. And, to the extent damping does occur, it is consistent from one shot to the next.

Like all projectile-firing weapons, a recoil transfer mount of some type must be provided. The phrase "recoil transfer mount" means a component or compnents that transfers the impulse created by firing the weapon to an external object. In the case of a shoulder-fired embodiment, the external object is the shooter. A second embodiment is a deck gun such as used on a naval vessel. These tend to be larger-caliber weapons that cannot be comfortably fired from a user's shoulder. In this second embodiment the recoil transfer mount is a pair of trunnions attached to rear barrel frame 34. The trunnions slip downward into a pivoting yoke. A human user still aims and fires this embodiment, but the recoil passes through the trunnions to the yoke. The yoke typically pivots within a vertical steel tube that is welded to the deck.

The embodiment of FIG. 5 is of course intended to be a shoulder-fired weapon. In this case the recoil transfer mount is configured to pass the firing impulse to the shooter's shoulder. Gripping features are also preferably provided. A longitudinal beam is provided to support the gripping features and to convey the recoil impulse to butt plate 28. In the embodiment shown, a pair of stiff rods are used for this longitudinal beam. Right comb rod 22 and left comb rod 24 are connected to central barrel frame 36, rear barrel frame 34, and butt plate 28. The connections are again preferably made using a high-strength cross-linking polymer that locks these components together. Other embodiments use mechanical methods to make the connections—such as clamps or locating screws or pins.

Trigger group shroud 18 is mounted on right comb rod 22 and left comb rod 24. Pistol grip 20 is mounted on trigger group shroud 18. Heel rod 26 links the lower part of pistol grip 20 to the heel portion (lower portion) of butt plate 28. As stated previously, trigger 68 and the trigger group to which it is attached are attached to the rear part of receiver 14 (typically referred to as the "tang" of the receiver). The attachment of the trigger group to the receiver tang is conventional in the art. Trigger group shroud 18 surrounds and protects the trigger and the trigger group. However, trigger group shroud 18 is preferably not directly attached to the trigger group, the trigger, or the receiver. Sufficient clearance is preferably maintained within the trigger group shroud so that it does not contact the trigger or the trigger group. Sufficient clearance preferably maintained so that the trigger group shroud does not contact any portion of the receivier or bolt.

In the inventive design, receiver 14 touches only the barrel. It is not connected to any other portion of a component that could be called a "stock." The trigger group is connected to the tang portion of the receiver, but the trigger group touches nothing else.

Returning now to FIG. 4, some additional components will be explained. In long-range shooting it is customary to rest a portion of the rifle on a steadying object—such as a sandbag. When a conventional stock is present, the stock's fore end is often the portion that is rested on the sandbag. It is generally undesirable to rest the barrel itself on the steadying object since this will tend to damp the barrel's motion doring the period of internal ballistics (while the projectile is still accelerating down the bore).

Many sandbags used in shooting competitions have a specially-shaped channel for the rifle's barrel and forend to rest in. In the emoodiment of FIG. 4, lower barrel rods 44, 46 are deaigned to rest on the supporting sand bag with the bottom of each lower barrel rod being aligned with the axis of the barrel. This configuration is believed to produce less muzzle rise upon firing.

Forward barrel frame 38 links the forward end of barrel rods 40, 42, 44, 46 together. In the embodiment shown, forward barrel frame 38 has a central bore that is large enough for barrel 12 to pass freely through it without any contact between the forward barrel frame and the barrel. The four rods 40, 42, 44, 46 are stiff enough so that even when forward harrel frame 38 is placed on a steadying object the forward barrel frame does not come into contact with the barrel. In other embodiments, forward barrel frame 38 is bedded to the barrel in the same way as rear barrel frame 34 and central barrel frame 36.

In the embodiment depicted in FIG. 4, pad 30 is added to the rear of butt plate 28. Length-of-pull adjustment 32 allows the distance between pad 30 and butt plate 28 to be adjusted. "Length-of-pull" generally refers to the distance between a weapon's trigger and the rearmost point of the weapon that contacts the user's shoulder pocket. A proper length-of-pull for a particular user is often said to be the distance between the inside of a user's elbow and the user's trigger finger. This length is preferably adjusted to enhance user comfort. The adjustment mechanism 32 allows the length-of-pull to be adjusted by moving pad 30 rearward or forward with respect to butt plate 28.

Pad 30 preferably includes other beneficial features, such as a soft cushioning layer. Length-of-pull adjustment 32 may also include a recoil-absorbing telescoping cylinder. Other features known in prior art recoil pads may be included as well.

Figure 6:
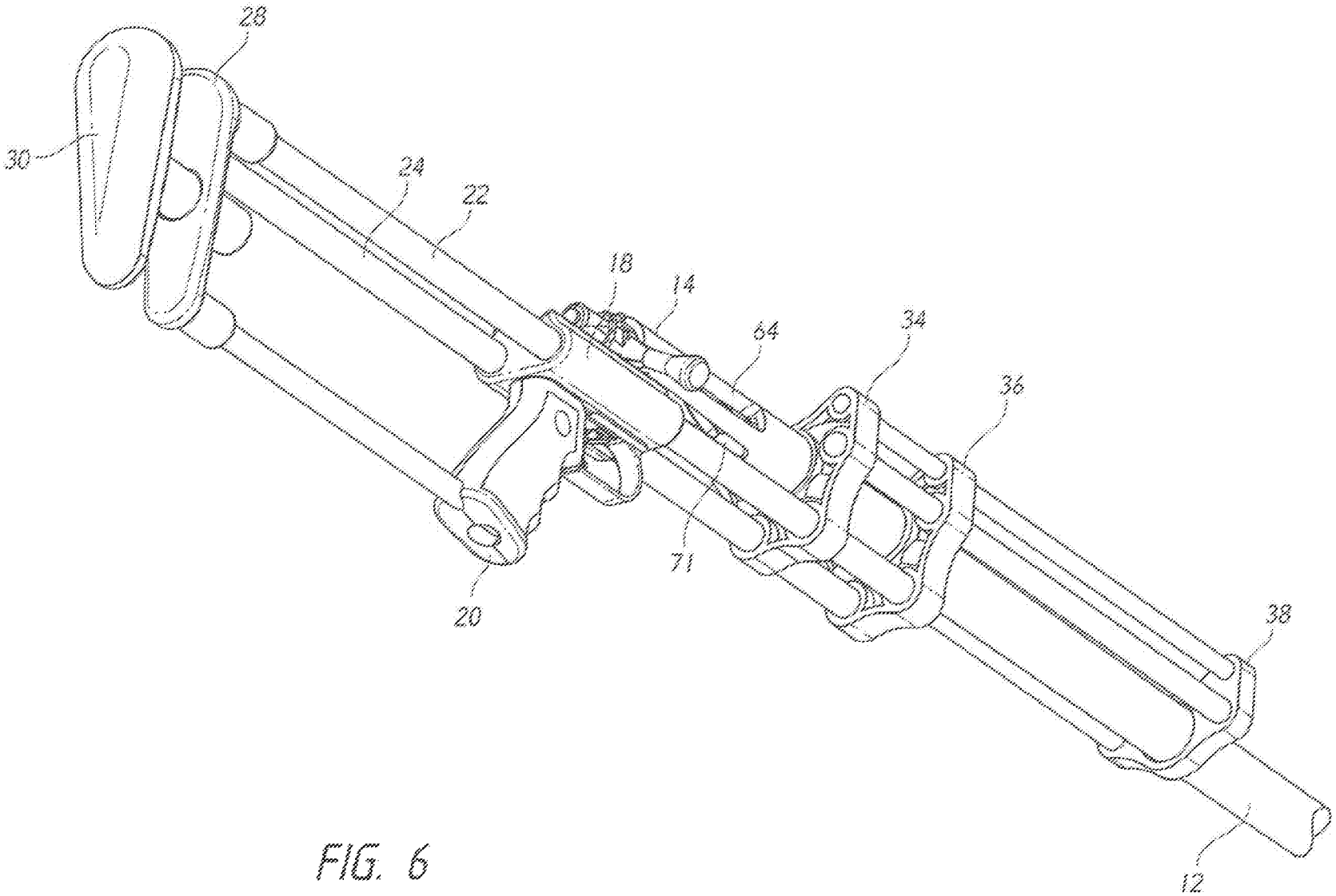
FIG. 6 is a perspective view, showing the area of FIG. 5 from a different vantage point.

FIG. 6 shows the same assembly from a different vantage point. Receiver 14 includes ejection port 64 on its right side. The receiver also include bottom port 71. Bottom port 71 may be used to receive a cartridge for loading. It may also be used to receive the upper portion of a magazine configured to contain multiple cartridges. If a magazine is desired, the lateral spacing between the comb rods 22, 24 is made large enough to accommodate the magazine's width.

Figure 7:
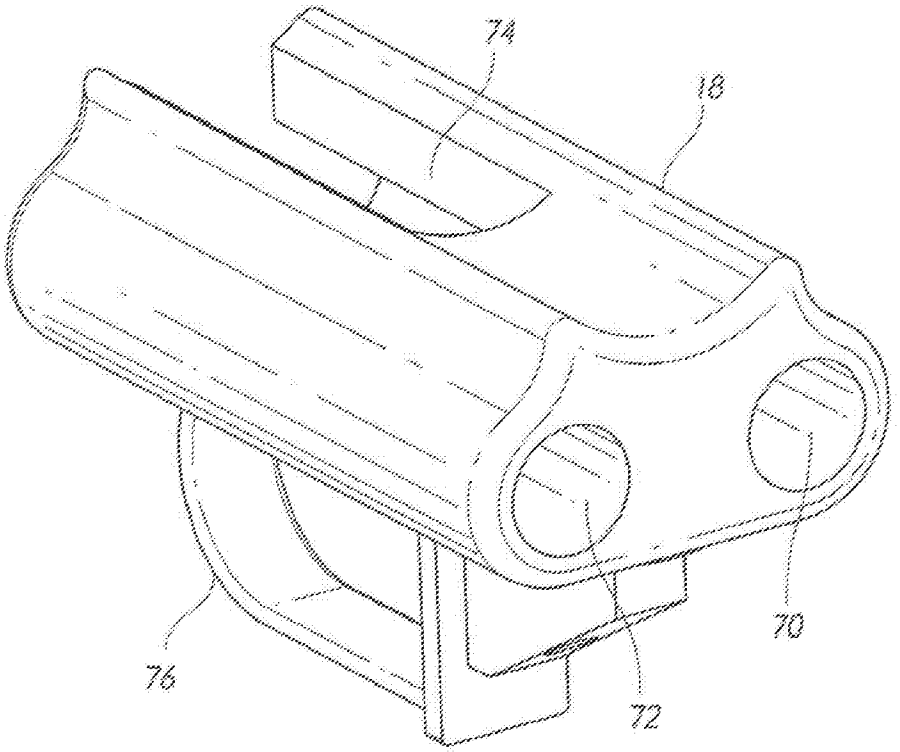
FIG. 7 is a perspective view, showing the trigger guard shroud.
Figure 8:
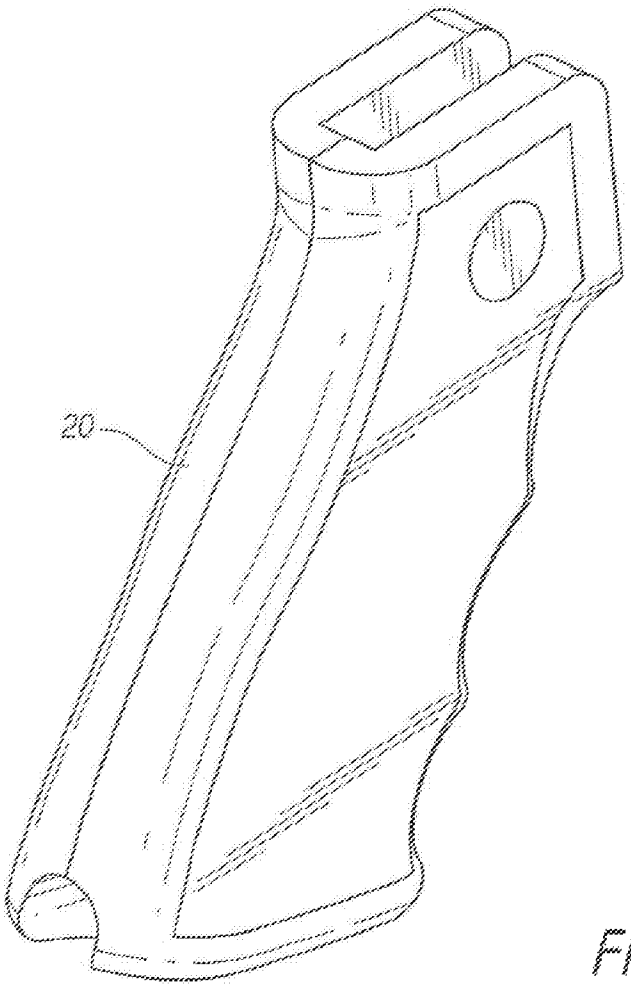
FIG. 8 is a perspective view, showing a pistol grip configured to attach to the trigger guard shroud.
Figure 9:
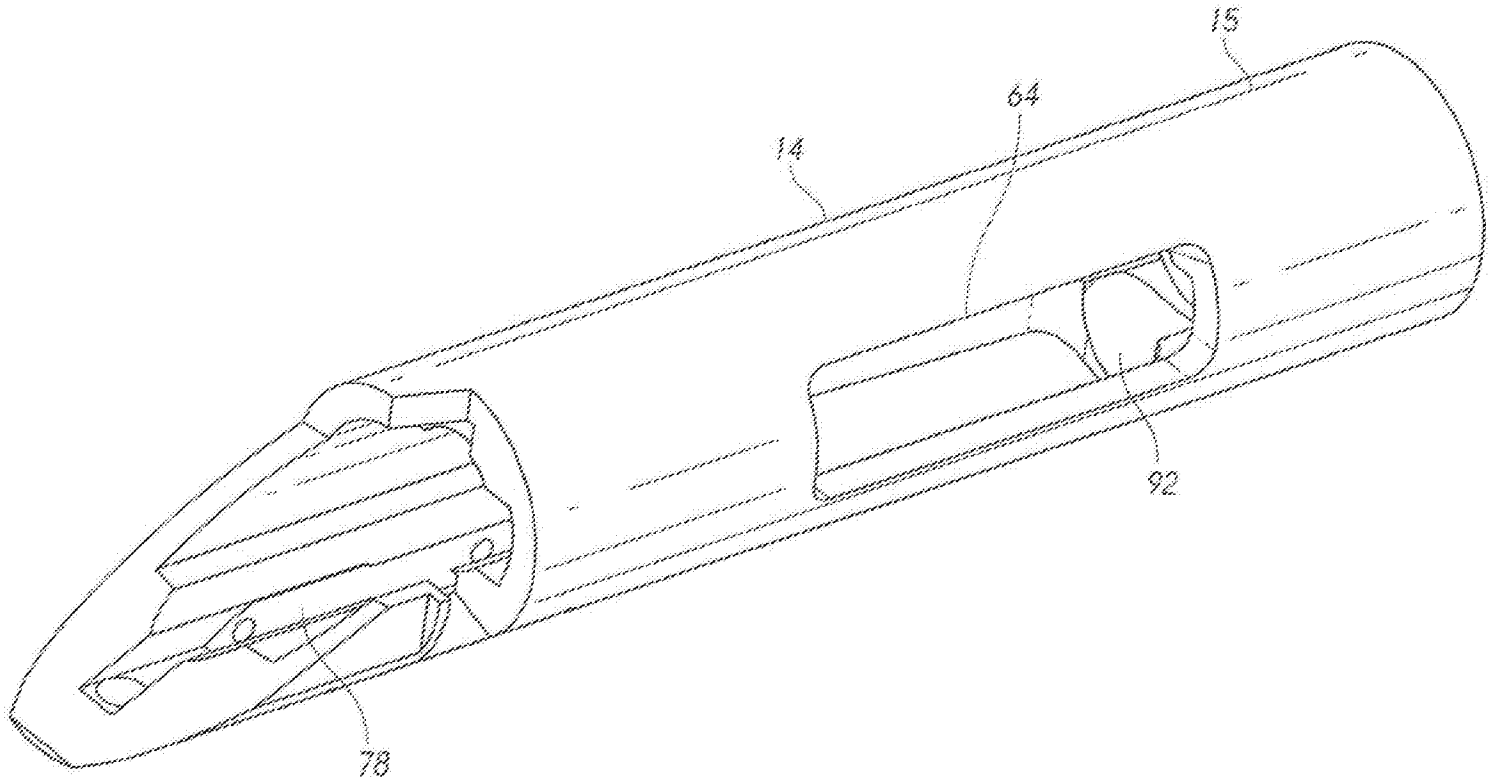
FIG. 9 is a perspective view, showing an exemplary receiver as used in embodiments of the present invention.

FIGS. 7-9 show some of the individual components in greater detail. FIG. 7 depicts trigger guard shroud 18. The upper portion of the trigger guard includes an arcuate relief intended to provide clearance for the lower portion of the receiver. Trigger group slot 74 provides clearance for the trigger group (including the trigger). Trigger guard 76 surrounds the trigger itself.

Left comb rod bore 72 is sized to accomodate the left comb rod in a sliding fit. Likewise, right comb rod bore 70 is sized to accommodate the right comb rod. The trigger guard shroud is preferably connected to the comb rods using a cross-linking adhesive.

FIG. 8 shows pistol grip 20. The pistol grip is designed to attach to a tang descending from the rear of trigger group shroud 18. A lateral fastener is passed through the bore proximate the top of the pistol grip. A slot in the bottom of the pistol grip is configured to receive and connect heel rod 26.

FIG. 9 provides a detailed view of receiver 14. This is a conventional component. It includes a female threaded section within receiver ring 15. The female thread receives the threaded shank on the barrel—as is common for bolt-action rifles descended from the Mauser 98 design. Feed ramp 82 directs magazine-fed cartridges up and into the firing chamber.

The rear lower portion of the receiver is often referred to as the tang. Trigger group mount 78 is located in this region. A suitable trigger group is connected to the receiver—typically by inserting two lateral pins. The trigger group includes one upstanding sear that engages a block on the rear of a firing pin located within the bolt. The function of the trigger group is to reliably and repeatably release the sear (and thereby release the firing pin) when the trigger is pulled. Such trigger groups are well known in the field of bolt-action rifles and firearms in general.

Figure 10:
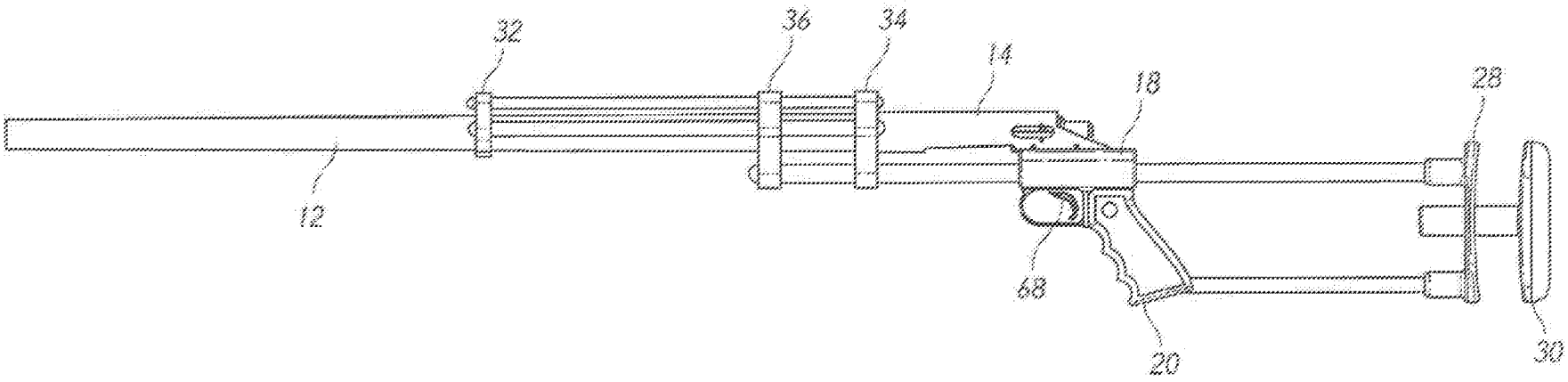
FIG. 10 is a side elevation view, showing an embodiment of the preaent invention.

FIG. 10 shows a side elevation view of the modular rifle in an assembled state. The reader will note how trigger group shroud 18 surrounds the trigger group. The location of pistol grip 20 and pad 30 allows the rifle to be gripped in a conventional fashion—even though the rifle is of an unconventional design.

Figure 11:
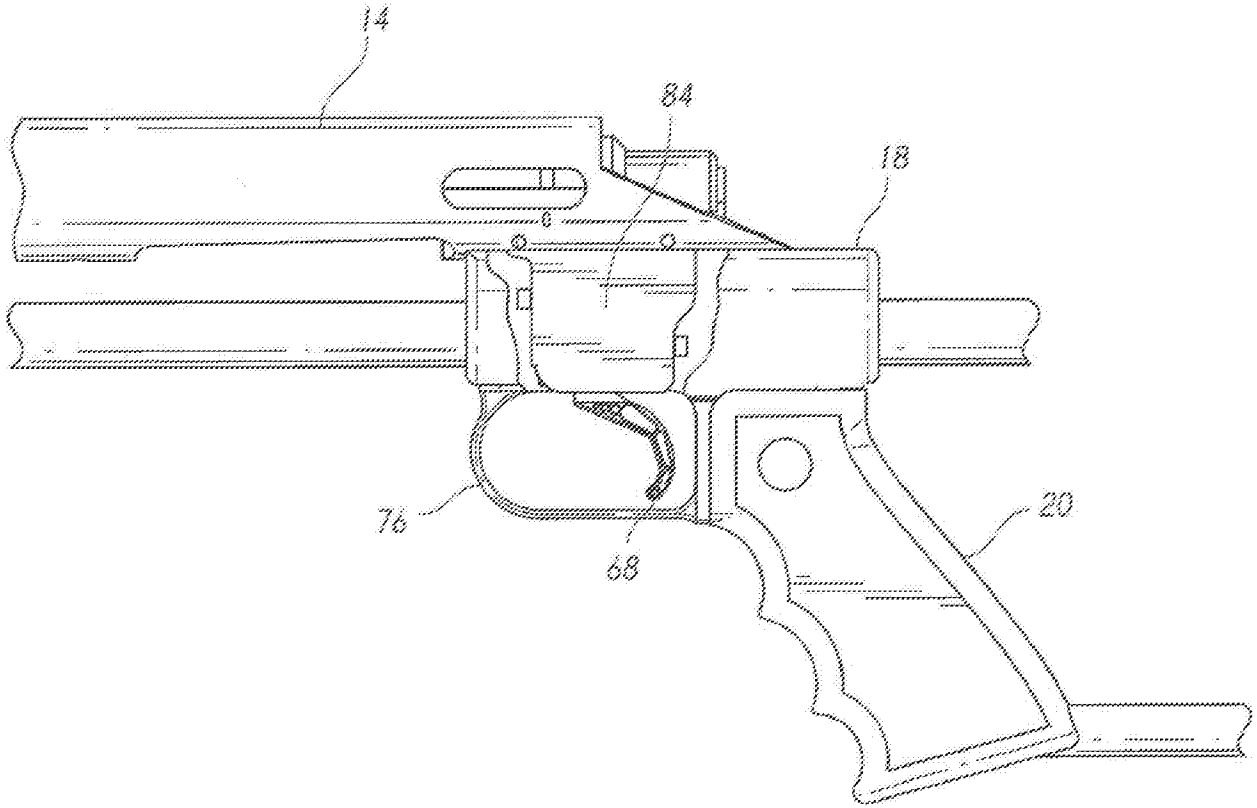
FIG. 11 is a detailed elevation view with a cutaway, showing how a trigger group is contained within the trigger group shroud.

FIG. 11 shows an enlarged view in the vicinity of trigger group shroud 18. A cutaway is provided in the trigger group shroud so that the user can see trigger group 84. As stated previously, trigger group 84 extends downward into the trigger group shroud, but does not touch it. Receiver 14 and its attached trigger group 84 "float" with respect to the trigger group shroud and the two comb rods.

Figure 12A:
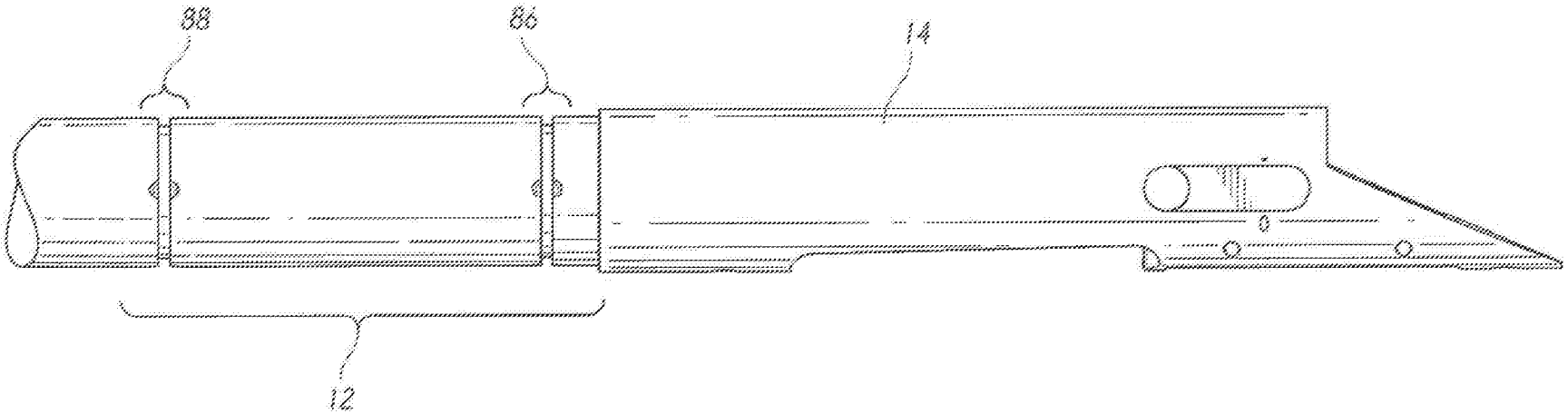
FIG. 12A is a side elevation view, showing a barrel used in the present invention joined to a receiver.

Having now described the structure of the inventive rifle, the prefened methodology of connecting the barrel frames to the barrel will be described in detail. FIG. 12A shows an elevation view of barrel 12 attached to receiver 14. The exterior surface of barrel 12 preferably contains additional features in rear frame area 86 and central frame area 88. In this example the exterior surface features in the two areas 86, 88 are the same.

Figure 12B:
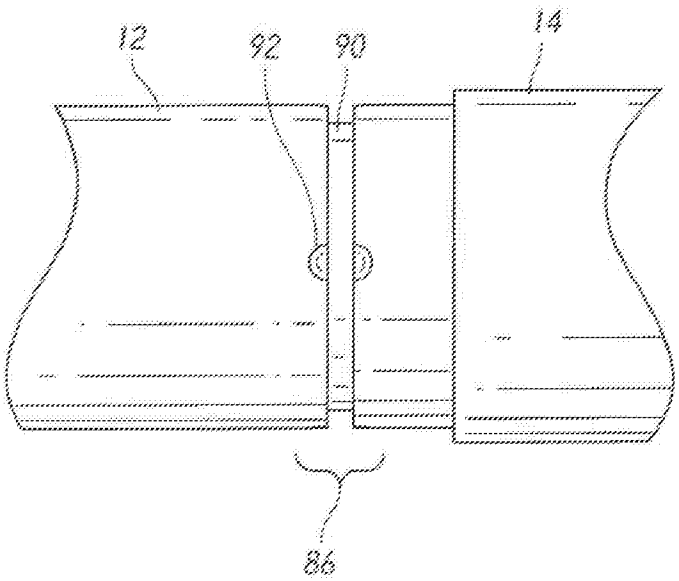
FIG. 12B is a detailed elevation view, showing the rear frame area of the barrel.

FIG. 12B shows rear frame area 86 in greater detail. The exterior surface of barrel 12 in the portion shown includes a barrel groove 90. One suitable method for adding such grooves is to cut them into the barrel's exterior surface using a lathe. In addition, one or more pockets 92 are provided. In the example shown each pocket 92 is made by plunging a ball-end mill into the barrel's exterior surface in a direction that is perpendicular to the surface (using a milling machine). In this version four separate pockets 92 are provided. These are spaced in 90 degree increments around the barrel's circumference.

Figure 13:
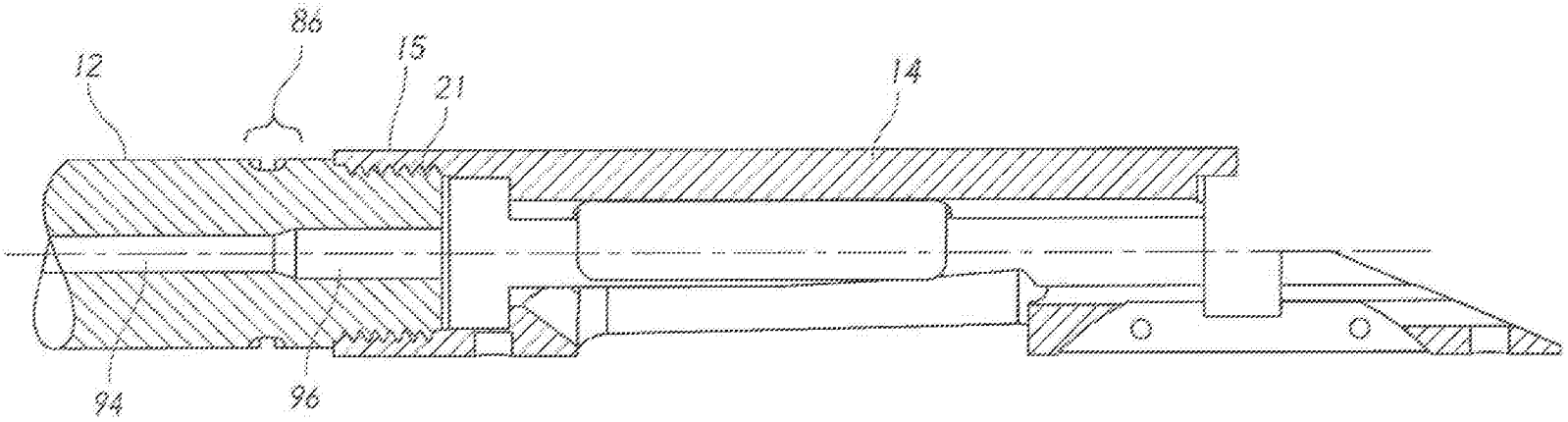
FIG. 13 is a sectional elevation view, showing the relationship of the rear frame area to the barrel/receiver interface.

FIG. 13 shows a sectional elevation view through the assembly of FIG. 12. The reader will note the position of rear frame area 86 (close to receiver ring 15 and threaded shank 21). The groove cut into the barrel has a significant depth. However, the barrel used has a thick enough well that the groove depth comes nowhere near chamber 96 or bore 94.

Figure 14:
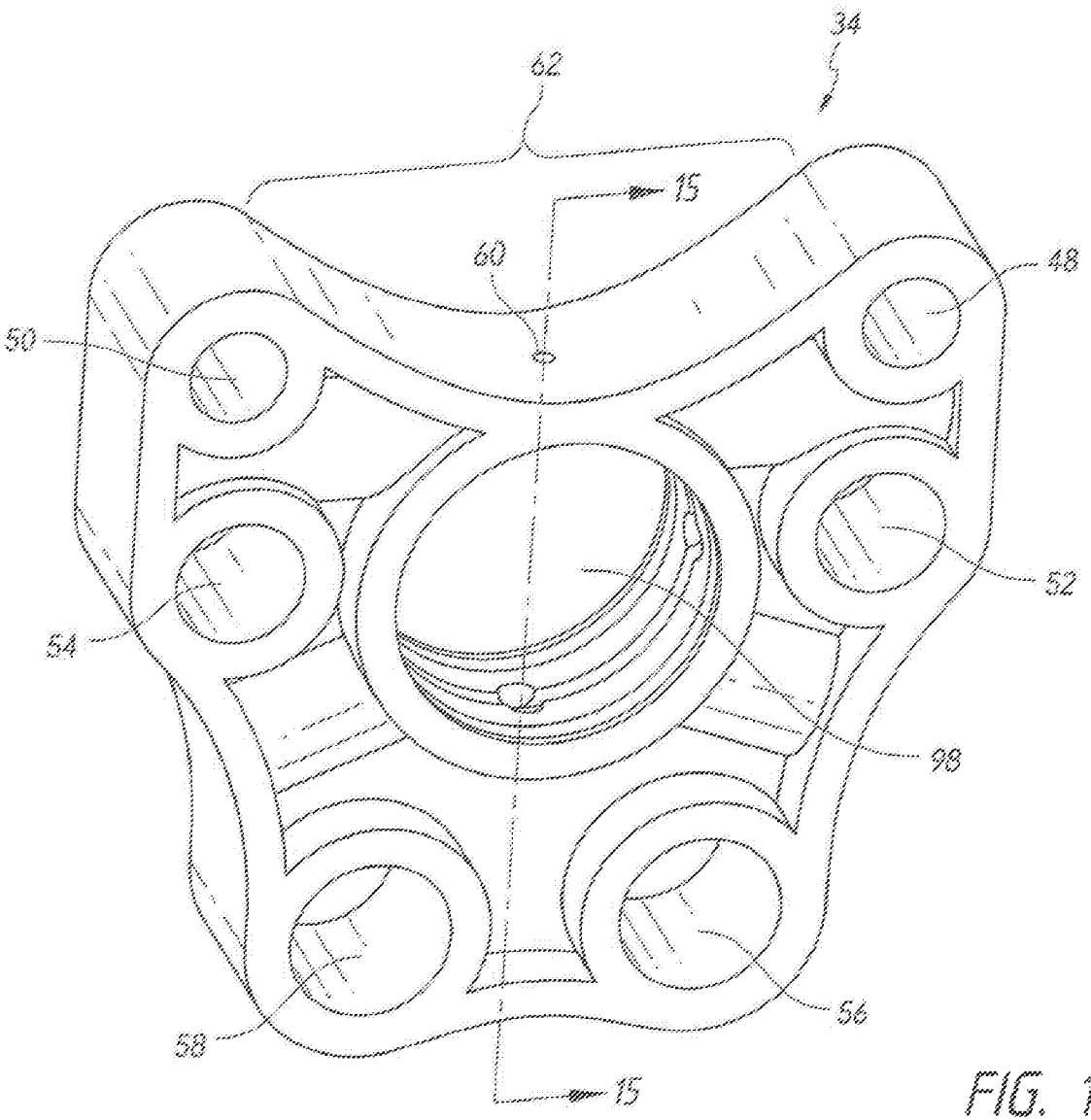
FIG. 14 is a perspective view, showing an exemplary rear barrel frame.

FIG. 14 shows a perspective view of rear barrel frame 34. Scope relief 62 in the upper portion of the barrel frame provides clearance for a telescopic sight. Upper right barrel rod bore 48 allows upper right barrel rod 40 to pass through and connect to the rear barrel frame. Upper left barrel rod bore 50 facilitates the connection of upper left barrel rod 42. Lower right barrel rod bore 52 facilitates the connection of lower right barrel rod 44. Lower left barrel rod bore 54 facilitates the connection of lower left barrel rod 46.

Right comb rod bore 56 facilitates the connection of right comb rod 22. Left comb rod bore 58 facilitates the connection of left comb rod 24. Central bore 98 provides a close sliding fit over the outer diameter of the barrel. This central bore includes grooves and pockets that are analogous to those found on the barrel. Injection port 60 allows the introduction of a liquid bonding material (such as a high-strength cross linking polymer) for connecting the rear barrel frame to the barrel.

Figure 15:
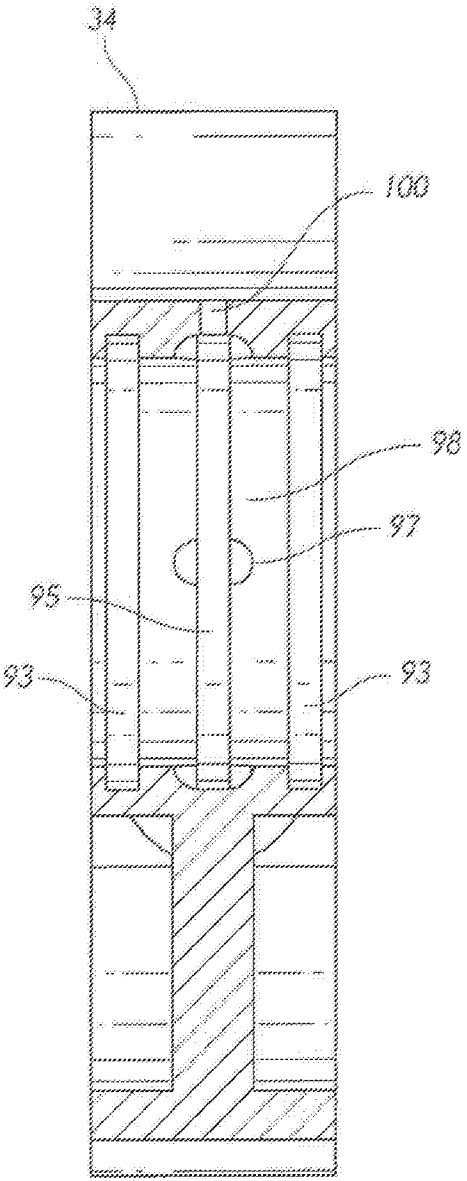
FIG. 15 is a sectional view through the rear barrel frame of FIG. 14.

FIG. 15 shows a section view through the mid plane of rear barrel frame 34. A central frame groove 95 is provided. This is positioned to align with the corresponding groove in the rifle barrel. Four pockets 97 are also provided in the central frame groove. These are spaced at 90 degree imervals around the frame groove's perimeter. They align with the milled pockets in the barrel groove. In addition to central frame groove 95 are two O-ring groove 93. These are designed to receive O-rings, as will be explained.

Figure 16:
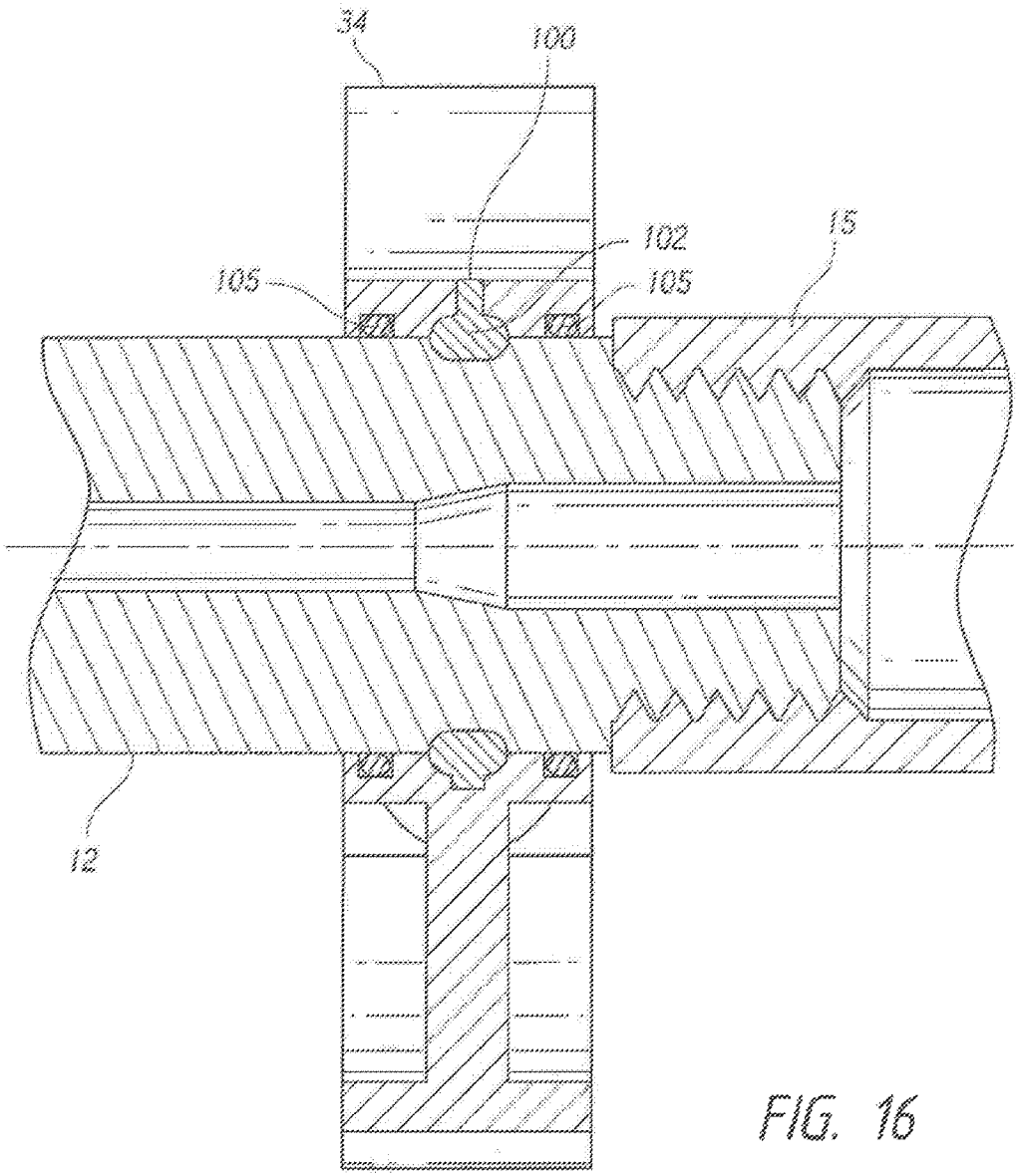
FIG. 16 is a sectional view through the rear barrel frame, barrel, and receiver with the rear barrel frame in an installed state.

FIG. 16 shows a asection view with rear barrel frame 34 installed on barrel 12 in a position where the central frame groove aligns with the corresponding barrel groove. O-rings 105 are placed within the O-ring grooves in the rear barrel frame. These are typically installed in the rear barrel frame and the rear barrel frame is then slid along the barrel's exterior and into position. The O-rings tend to center the rear barrel frame on the barrel. They also serve as a seal to prevent the leakage of the bonding material out of the rear barrel frame.

A jig may be used to ensure the proper relationship between the rear barrel frame and the barrel during the assembly, though the O-rings typically provide sufficient fixturing. Liquid bonding material is injected through fill port 100. Many materials can be used for the liquid bonding material. A two-part high-strength epoxy is one good example. This material is injected as a liquid. It flows around and fills the voids that are created by frame groove 9S, barrel groove 90, pockets 92 (in the barrel), and pockets 97 (in the rear barrel frame).

The bonding material is thin enough to flow through the small gap between the barrel and the barrel frame and fill all the voids. One or more vents may be added to the barrel frame to aid in the purging of any entrapped air. The O-rings tend to prevent unwanted leakage. Additional sealing materials such as tape or molding clay can be added if necessary.

The bonding material is preferably a cross-linking polymer that transitions to a solid over time (though the reader should bear in mind that the "solid" form of a polymer is not an ordered crystalline structure such as found in steel or aluminum). The solid formed is preferably somewhat flexible to allow some motion between the barrel and the frames. As stated previously, one can use a cross-linking epoxy or a thermoset elastomer. A molded urethane may also be used. As the bonding material remains in the voids it fills them and then transitions completely to a solid. Filler material may be used in the bonding material to provide additional strength. Filler examples include glass fibers, metallic particles, and small glass beads.

Bonding material 102 eventually solidifies and occupies the voids shows in FIG. 16. The bonding material in the grooves locks barrel frame 34 to barrel 12 in the longitudinal direction. The bonding material in the pockets locks the two components together in the rotational direction.

Figure 17:
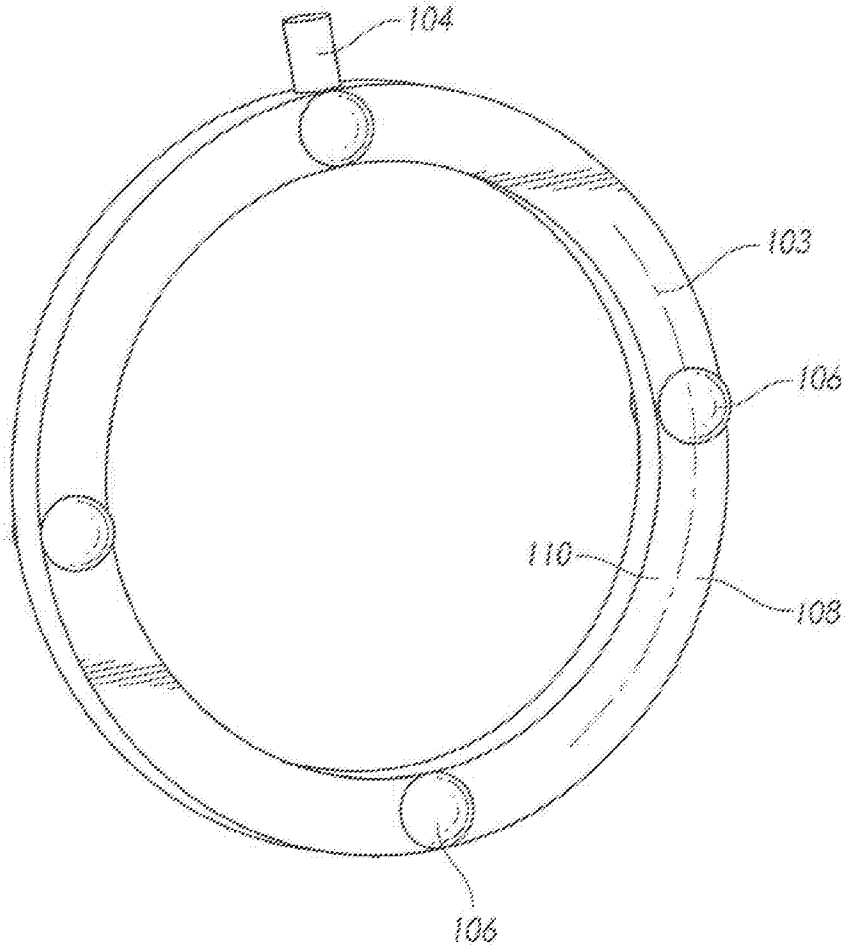
FIG. 17 is a perspective view, showing a bonding material ring on its own.

FIG. 17 shows a depiction of the solified bonding material lying in the central groove in the rear frame and the barrel, as well as the associated pockets. Sprue 104 is the solid material remaining within fill port 100. Inner portion 110 lies within barrel groove 90. Outer portion 108 lies within frame groove 95. Domes 106 lie within the pockets made using a ball end mill. The presence of this solidified mass of bonding material locks rear barrel frame to the barrel.

The central barrel frame in this example is identical to the rear barrel frame. It is locked to the barrel using the same technique. It is also possible to lock the various rods to the frames using the bonding material as well. Additional fill ports may be added as desired for this purpose.

Figure 18:
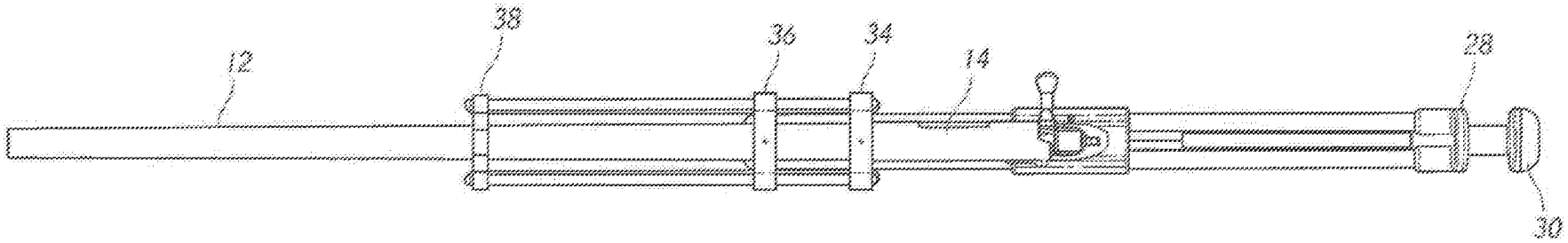
FIG. 18 is a top view showing an embodiment of the present invention.
Figure 19:
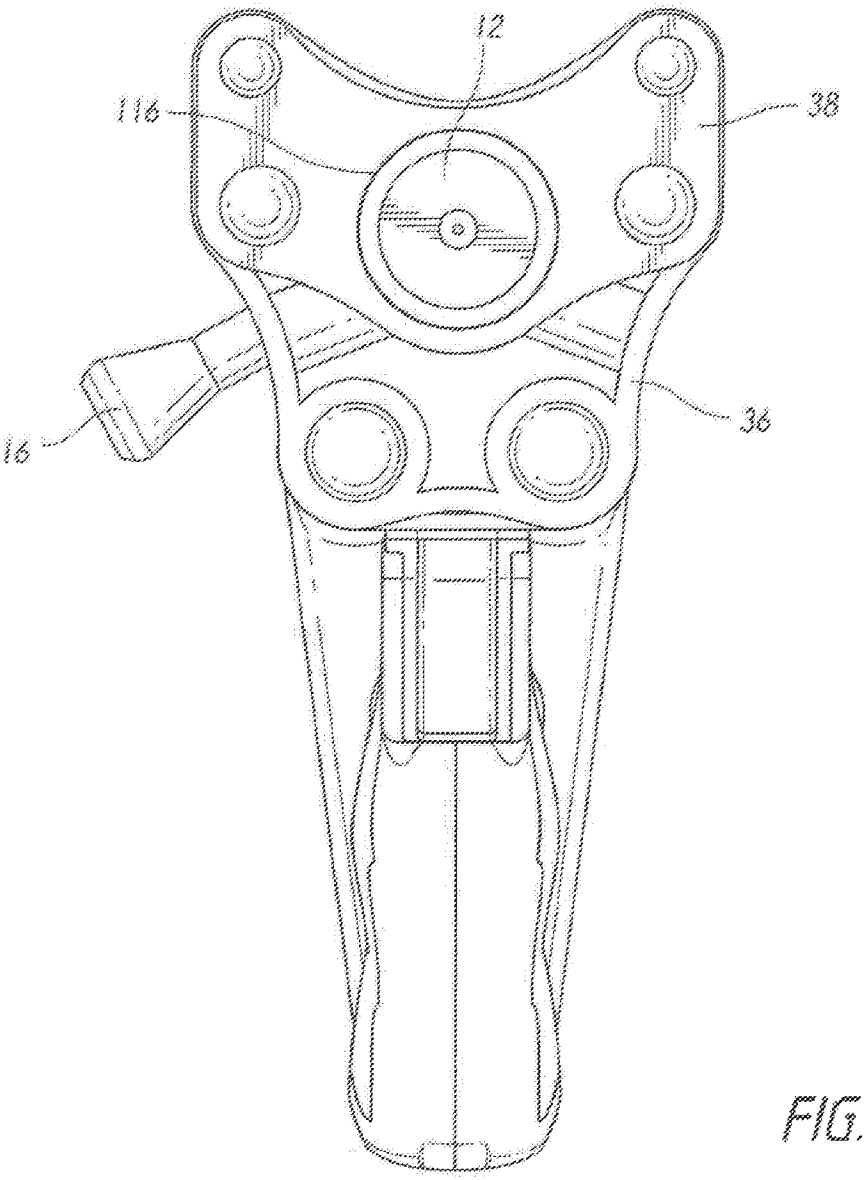
FIG. 19 is a front view showing an embodiment of the present invention.

FIG. 18 shows a top view of the completed assembly. FIG. 19 shows a front view. The reader will observe how clearance bore 116 in forward barrel frame provides significant clearance around barrel 12. As stated previously, this clearance is provided in this example so that the barrel does not touch the forward barrel frame. However, in other embodiments, the forward barrel frame will be bonded to the barrel using the same techniques as described for the rear and central frames.

Figure 20:
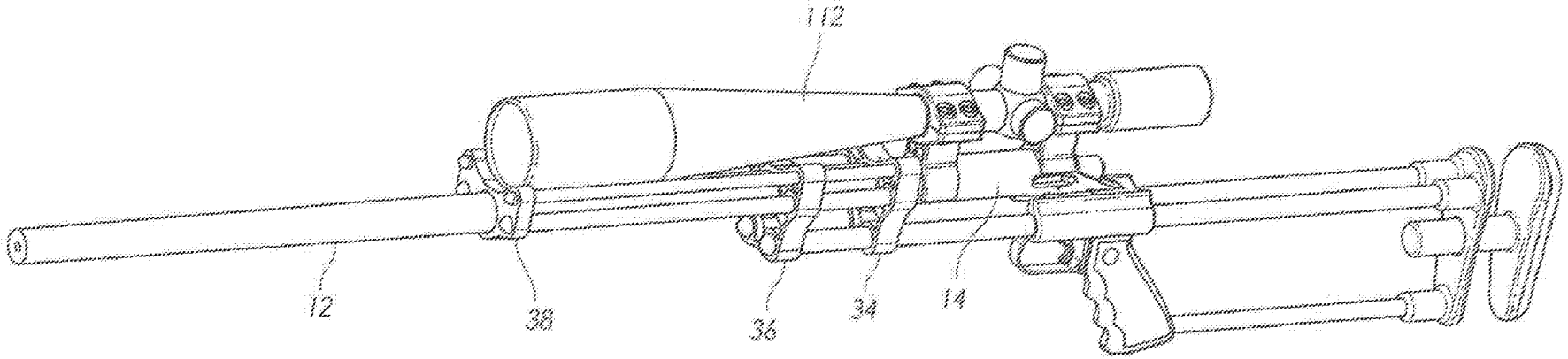
FIG. 20 is a perspective view, showing the addition of a telescopic sight.

FIG. 20 shows a perspective of the assembled rifle with telescopic sight 112 added. As those skilled in the art will know, rifles used for long-range shooting typically include a telescopic sight. The sight must be connected to the rifle. It is common to connect the telescopic sight to receiver 14.

Figure 21:
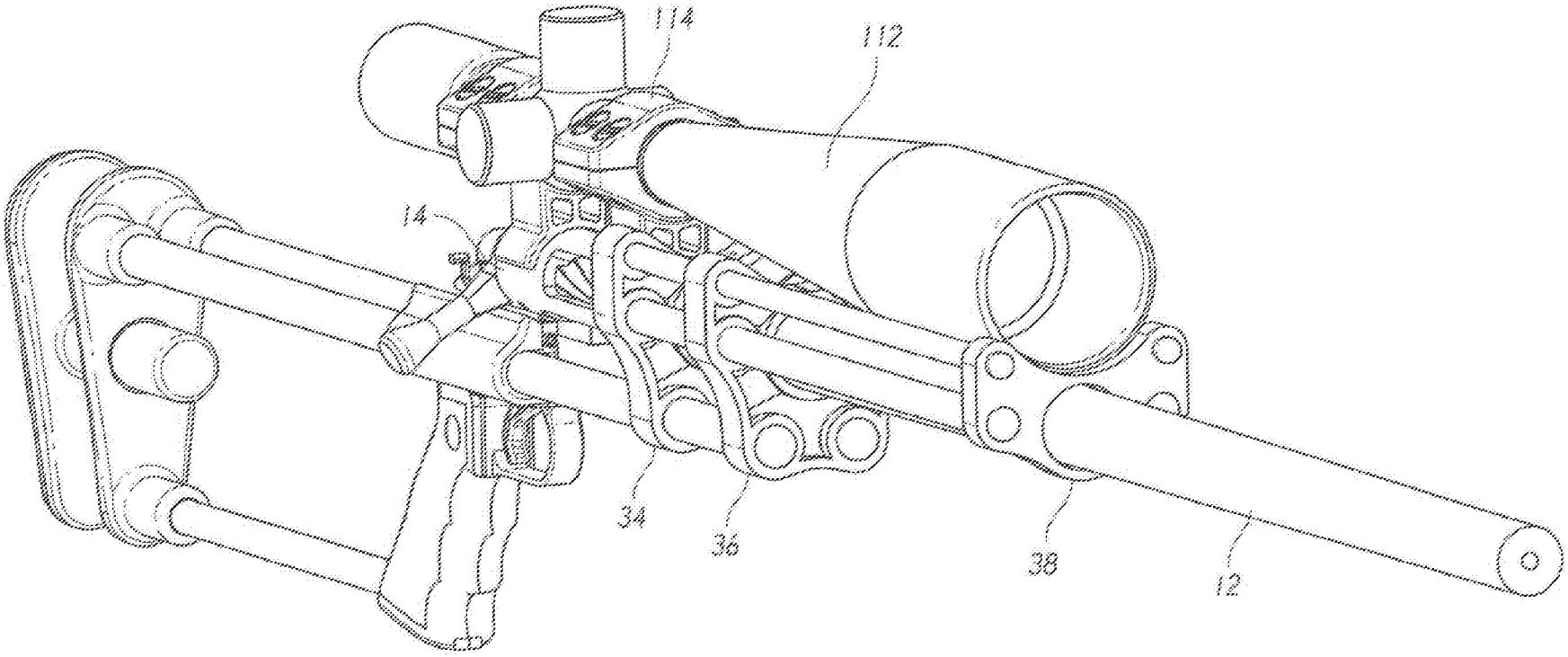
FIG. 21 is a perspective view, showing an exemplary scope mount.

FIG. 21 shows a scope mount 114 connecting telescopic sight 112 to the receiver. It is also possible to attach the telescopic sight to the rifle barrel. Another option is to connect the telescopic sight to rear barrel frame 34 and central barrel frame 36. The reader will observe that cleurance is provided for the three barrel 34, 36, 38 so that they do not interfere with a large telescopic sight.

The materials used for the components of the invention should be selected to provide appropriate strength, toughness, and stiffness. In addition, it is desirable to match the coefficients of themal expansion. To that end, the barrel frames and various rods can be made of a metal such as steel. It is also possible to make thesse components of reinforced composites.

Many other variations are possible within the scope of the present invention. These include:

1. The receiver will not always be a separate piece that is joined to the barrel. The receiver could be integrally machined with the barrel.

2. If the receiver is separate from the barrel, it may be joined by brazing or some means other than a threaded joint.

3. The central barrel frame and rear barrel frame could be made as one integral piece.

4. The central and rear barrel frames could be joined to the barrel using a threaded joint. In such a case it would be preferable to step down the outer diameter of the barrel in stages, so that a larger thread diameter could be used for the rear barrel frame and a smaller one could be used for the central barrel frame.

5. The bonding material could be a liquid metal, such as solder.

6. The action could be a semi-automatic sction rather than a bolt action. For example, the action could be a semi-automatic action of the type used in the U.S. Army's M-107.

Some of the invention's significant features are:

1. The barrel/action is attached to a mounting frame (stock) with no metal-to-metal contact. The bonding material fills this gap.

2. The invention allows the to resonate at (or nearer to) its frequency during firing.

3. The invention allows resonance tuning by manipulating the spacing betwe nthe barrel frames and altering the bonding material used.

4. The invention allows for the front rest supports to be in plane with the axis of the barrel during firing, and this eliminates muzzle rise.

5. The cooling of the barrel is improved as its surface is more exposed.

The preceding description contains significant detail regarding novel aspects of the present invention. It should not be construed, however, as limiting the scope of the invention but rather as providing illustrations of the preferred embodiments of the invention. The features disclosed can be combined in many more ways that have been described—all of which are within the scope of the present invention. Thus, the scope of the invention should be fixed by the following claims, rather than specific examples given.

Having described my invention, I claim:

1. A weapon, comprising:

(a) a barrel having a breech end and a muzzle end;

(b) a receiver attached to said breech end of said barrel;

(c) a first barrel frame connected to said barrel proximate said receiver;

(d) a second barrel frame connected to said barrel between said first barrel frame and said muzzle end of said barrel, said second barrel frame being connected to said first barrel frame;

(e) a recoil transfer mount;

(f) said first barrel frame being connected to said recoil transfer mount;

(g) a first void provided in said barrel proximate said receiver;

(h) a second void provided in said first barrel frame, said second void being aligned with said first void in said barrel; and wherein said first barrel frame is connected to said barrel by bonding material that fills said first void and said second void.

2. The weapon as recited in claim 1, wherein said second barrel frame is connected to said barrel by said bonding material.

3. The weapon as recited in claim 1, wherein:
(a) said first void comprises a first barrel groove proximate said receiver;
(b) said second void comprises a first frame groove that is aligned with said first barrel groove; and
(c) said bonding material fills said first barrel groove and said first frame groove.

4. The weapon as recited in claim 3, wherein said bonding material is a cross-linking polymer that is introduced in a liquid state and which transitions over time into a solidified state.

5. The weapon as recited in claim 4, wherein said first barrel frame includes a fill port configured to receive said bonding material in said liquid state, with said fill port being connected to said first frame groove.

6. The weapon as recited in claim 3, wherein:
(a) said barrel receiver includes a second barrel groove proximate said first barrel groove;
(b) said first barrel frame includes a second frame groove that is aligned with said second barrel groove; and
(c) said bonding material fills said second barrel groove and said second frame groove.

7. The weapon as recited in claim 3, wherein:
(a) said first void includes a first barrel pocket;
(b) said second void includes a first frame pocket; and
(c) said bonding material fills said first barrel pocket and said first frame pocket.

8. The weapon as recited in claim 1, wherein:
(a) said recoil transfer mount includes a butt plate;
(b) said connection between said first barrel frame and said recoil transfer mount is a longitudinal beam; and
(c) said longitudinal beam connects said first barrel frame, said second barrel frame, and said butt plate.

9. The weapon as recited in claim 8, further comprising a trigger group connected to said receiver, said trigger group including a trigger.

10. The weapon as recited in claim 9, further comprising a trigger group shroud connected to said longitudinal beam, said trigger group shroud surrounding said trigger group.

11. A weapon, comprising:
(a) a barrel having a breech end and a muzzle end;
(b) a receiver attached to said breech end of said barrel;
(c) a first barrel frame connected to said barrel proximate said receiver;
(d) a recoil transfer mount;
(e) said first barrel frame being connected to said recoil transfer mount; and
(f) said receiver being connected to said recoil transfer mount only through said barrel;
(g) a first void provided in said barrel proximate said receiver;
(h) a second void provided in said first barrel frame, said second void being aligned with said first void in said barrel; and
(i) wherein said first barrel frame is connected to said barrel by bonding material that fills said first void and said second void.

12. The weapon as recited in claim 11, further comprising
(a) a second barrel frame connected to said barrel between said first barrel frame and said muzzle end of said barrel; and
(b) said second barrel frame being connected to said first barrel frame.

13. The weapon as recited in claim 12, wherein said second barrel frame is connected to said barrel by said bonding material.

14. The weapon as recited in claim 11, wherein:
(a) said first void comprises a first barrel groove proximate said receiver;
(b) said second void comprises a first frame groove that is aligned with said first barrel groove; and
(c) said bonding material fills said first barrel groove and said first frame groove.

15. The weapon as recited in claim 14, wherein said bonding material is a cross-linking polymer that is introduced in a liquid state and which transitions over time into a solidified state.

16. The weapon as recited in claim 15, wherein said first barrel frame includes a fill port configured to receive said bonding material in said liquid state, with said fill port being connected to said first frame groove.

17. The weapon as recited in claim 14, wherein:
(a) said barrel receiver includes a second barrel groove proximate said first barrel groove;
(b) said first barrel frame includes a second frame groove that is aligned with said second barrel groove; and
(c) said bonding material fills said second barrel groove and said second frame groove.

18. The weapon as recited in claim 14, wherein:
(a) said first void includes a first barrel pocket;
(b) said second void includes a first frame pocket; and
(c) said bonding material fills said first barrel pocket and said first frame pocket.

19. The weapon as recited in claim 11, wherein:
(a) said recoil transfer mount includes a butt plate;
(b) said connection between said first barrel frame and said recoil transfer mount is a longitudinal beam; and
(c) said longitudinal beam connects said first barrel frame, said second barrel frame, and said butt plate.

20. The weapon as recited in claim 19, further comprising:
(a) a trigger group connected to said receiver, said trigger group including a trigger; and
(b) a trigger group shroud connected to said longitudinal beam, said trigger group shroud surrounding said trigger group.

* * * * *